United States Patent [19]

Haringer

[11] 4,403,429

[45] Sep. 13, 1983

[54] ARTICULATED ARM FOR EXCAVATOR MACHINES

[75] Inventor: Alois Haringer, Egna, Italy

[73] Assignee: VEMA, S.p.A., Egna, Italy

[21] Appl. No.: 314,968

[22] Filed: Oct. 26, 1981

[30] Foreign Application Priority Data

Nov. 4, 1980 [IT] Italy ..... 68686 A/80

[51] Int. Cl.[3] ..... E02F 5/02

[52] U.S. Cl. ..... 37/103

[58] Field of Search ..... 37/103, 117.5, 118; 414/784–787, 822

[56] References Cited

U.S. PATENT DOCUMENTS

| | | | |
|---|---|---|---|
| 2,846,094 | 8/1958 | Pilch | 37/103 |
| 3,139,199 | 6/1964 | Auwelaer | 37/103 X |
| 3,891,065 | 6/1975 | Iijima et al. | 37/103 X |
| 3,993,206 | 11/1976 | Jomen et al. | 37/103 X |
| 4,077,140 | 3/1978 | Branconi | 37/103 |
| 4,183,711 | 1/1980 | Schaeff | 414/687 |
| 4,261,684 | 4/1981 | Norton et al. | 37/117.5 |
| 4,314,789 | 2/1982 | Luigi | 37/103 |
| 4,332,094 | 6/1982 | Mieger | 37/103 |

FOREIGN PATENT DOCUMENTS

| | | | |
|---|---|---|---|
| 693296 | 8/1964 | Canada | 37/103 |
| 1462782 | 12/1966 | France | 37/103 |
| 664656 | 1/1964 | Italy | 37/103 |
| 696187 | 10/1965 | Italy | 37/103 |
| 464095 | 11/1968 | Switzerland | 37/103 |
| 2015963 | 9/1979 | United Kingdom | 37/103 |

*Primary Examiner*—E. H. Eickholt

*Attorney, Agent, or Firm*—Shlesinger, Arkwright, Garvey & Fado

[57] ABSTRACT

An articulated arm for excavator vehicles is described, which is able to make excavations lateral to said vehicles and parallel to the travelling direction thereof. The main characteristic of said arm is that it possesses two articulated joints which enable it to move the excavating bucket in a plane parallel to the plane in which said arm lies, thus obtaining lateral excavations with perfectly parallel walls perpendicular to the working floor.

4 Claims, 3 Drawing Figures

ARTICULATED ARM FOR EXCAVATOR MACHINES

BACKGROUND OF THE INVENTION

This invention relates to an articulated arm for excavators or similar earth moving machines, to be used in particular for excavations lateral to the vehicle and parallel to its travelling direction.

Excavators are known to comprise an articulated excavating arm usually on the centre line of a rotatable turret on which a control cab is positioned, this arm being controlled hydraulically and provided with a scoop shovel or other similar excavating means (buckets, reverse buckets etc.). It is also known that in order to economically carry out excavating works extending in a mainly longitudinal direction, such as ditches or trenches, a machine of the aforesaid type must operate by moving parallel to the excavation direction, i.e. must be able to make excavations parallel to its travelling direction.

This is attained by positioning the turret in such a manner that when in its operating position, the excavating arm is positioned along the longitudinal axis of the vehicle, the machine then being moved along the path of the excavation which is to be made. Thus, the excavator operates by straddling the excavation which is being made, its wheels or tracks being respectively on each of the two edges of the excavation, the axis of which thus approximately coincides with the longitudinal axis of the vehicle.

This method of working is the only one possible in the case of normal excavators, because the articulated arm carrying the excavating shovel is able to make movements only in the plane in which it lies, so that it must be moved into a position coinciding with the excavation position, while at the same time maintaining said plane parallel to the direction of travel. These considerations are also valid for those machines which are not excavators which either are provided or can be provided with excavating arms, generally of small size, such as tractors or rough terrain vehicles (tractors provided at the front with a collection shovel and at the rear with an excavating bucket).

However, in practice it is often not possible to operate by straddling an excavation due to lack of space or because natural or artificial obstacles exist on one or both sides thereof, such as a wall, columns or trees.

In order to be able to operate rapidly and economically in such a case, it is then necessary to make the excavation laterally to the vehicle so that it can move to the side of the obstacles without colliding with them.

Certain devices have therefore been constructed in order to produce a lateral excavation parallel to the directon of travel. One of these, designed specially for application to excavators, consists of an articulated arm which is able to move outside the plane in which it lies, and is composed of a number of rigid arms hinged together.

A first arm, hinged to the rotating turret in such a manner as to be able to move in a plane perpendicular to the plane of rotation of the turret, carries a second short arm hinged to it in the same manner and terminating in a platform. A third arm is hinged to the platform by a pin perpendicular to the plane of rotation of the turret, and is thus able to move outside the plane in which the first two arms lie, in a plane parallel to the turret plane. A fourth arm is hinged to the third arm, and carries the excavating shovel, which is able to move in the plane in which the third arm lies. In this manner, by simultaneously rotating the turret and third arm, the plane in which the shovel lies (namely the plane of the third arm) is made to coincide with the excavation plane, while keeping the vehicle parallel to the direction of the excavation but displaced laterally to it, even though the turret is rotated.

However, all these devices have serious drawbacks, and in particular have the grave defect of making a very poor lateral excavation, with its walls uneven and not perpendicular to the working floor, i.e. that on which the machine moves, thus requiring costly manual finishing work. This is because the excavating shovel moves along a curved trajectory instead of perpendicular to the working floor, because the movement of the first arm of the vehicle takes place in a plane which is not parallel to that in which the shovel operates.

SUMMARY OF THE INVENTION

The object of the present invention is to provide an articulated arm for excavator machines able to make lateral excavations parallel to the direction of travel of the vehicle on which it is mounted, and which is free from the aforesaid drawbacks, i.e. able to move the excavating shovel along a trajectory rigorously perpendicular to the working floor, and which also has a small overall width.

The present invention therefore provides an articulated arm able to be mounted on an excavator vehicle mobile on a working floor, and arranged to make an excavation lateral to said vehicle and parallel to the vehicle travelling direction, comprising a plurality of rigid arms hinged to each other by means of articulated joints, characterised in that at least two of said articulated joints allow movement in a plane parallel to said working floor.

BRIEF DESCRIPTION OF THE DRAWINGS

The present invention will be more apparent from the description of a preferred embodiment thereof given hereinafter by way of non-limiting example with reference to the accompanying drawings in which.

DETAILED DESCRIPTION OF THE INVENTION

Figure 1:
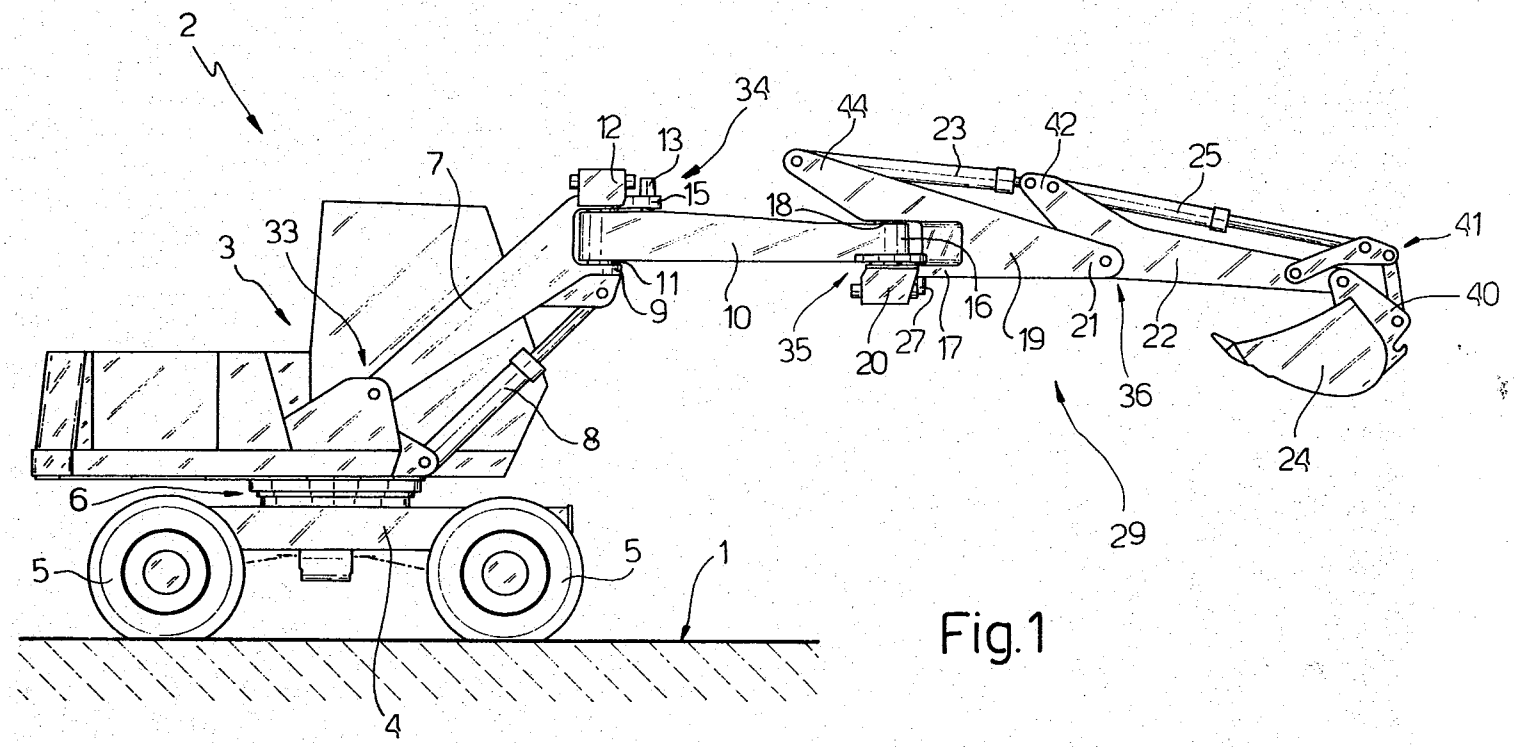
FIG. 1 is a side view of a wheel-mounted excavator on which the articulated arm according to the present invention is mounted.
Figure 2:
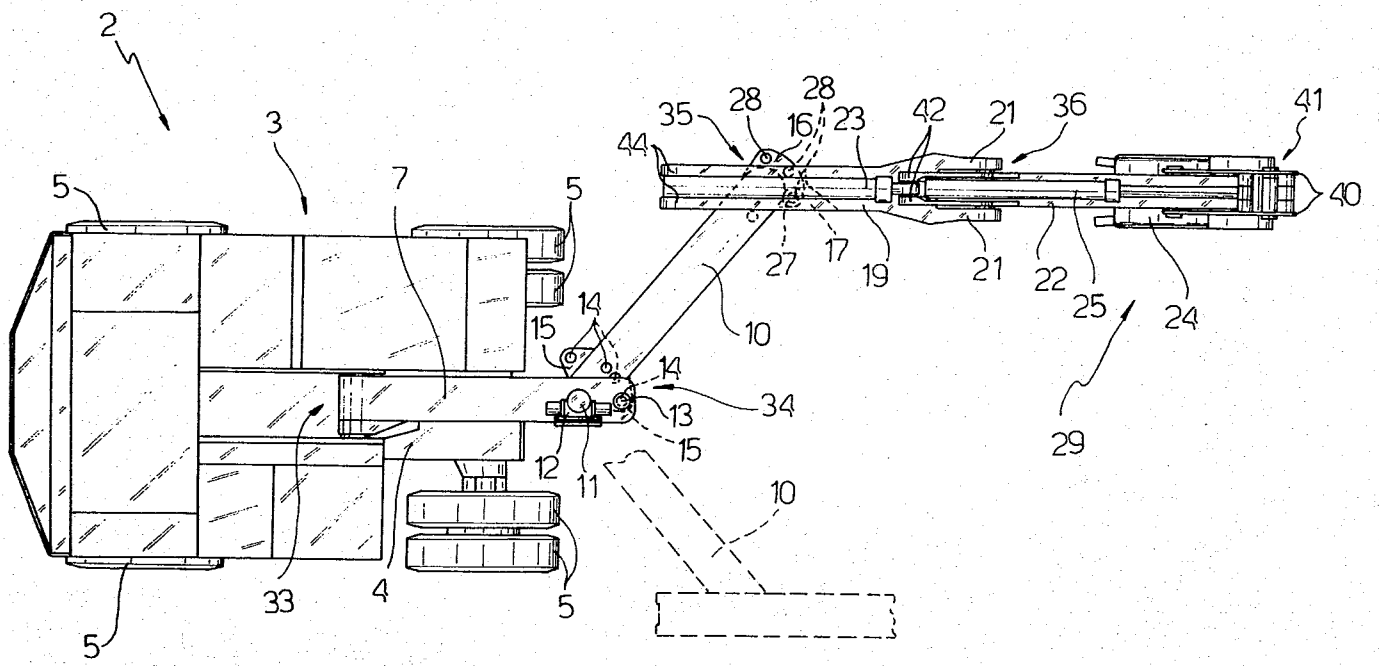
FIG. 2 is a plan view of the excavator of FIG. 1, with the arm displaced laterally.

With reference to FIGS. 1 and 2, the reference numeral 1 indicates a working floor on which an excavator 2 moves, this latter being composed of a rotatable turret 3, a chassis 4, rolling trains 5 and an articulated excavating arm 29. A first rigid arm 7 of steel or other suitably strong material is hinged by means of a horizontal trunnion 33 to the front of the rotatable turret 3, which can rotate in a plane parallel to the working floor 1 by means of a thrust bearing 6. The arm 7 can rotate in a plane perpendicular to the working floor 1, and coinciding with the vertical plane of symmetry of the excavator 2 when the turret 3 is not rotated. A first hydraulic rod actuator 8 hinged to the turret 3 and to the outer end of the arm 7 enables this latter to be moved in said plane so that it withdraws from or approaches the working floor 1.

The arm 7 terminates in a fork 9 which acts as a seat for a second rigid arm 10 of steel or other suitably strong material hinged to the arm 7 by means of an articulated joint 34 comprising a vertical pin 11 fixed to the arm 10 and substantially perpendicular to the floor 1, so that said arm 10 can rotate in a plane substantially parallel to the plane 1. A toothed wheel is connected to the upper end of the pin 11, and engages with a worm of a hydraulic actuator 12 of known type mounted on the arm 7. On said end of the arm 7 there is also disposed a vertical fixing pin 13 which can engage with bores 14 provided in the arm 10 or in lugs 15 rigid with the arm 10.

Said arm 10 terminates in another end 16 to which a third rigid arm 19 of steel or other suitably strong material is coupled by means of a fork 17 and a vertical pin 18 fixed to the arm 10 and constituting an articulated joint 35, this third arm being able to rotate by virtue of the pin 18 in a plane substantially parallel to the plane 1 and in practice coinciding with the plane of rotation of the arm 10. A toothed wheel is connected to the lower end of the pin 18 and engages with a worm of a hydraulic actuator 20 similar to the actuator 12 and fixed on to the arm 19. This latter, at its outer end 21, also carries a horizontal hinge pin 36 which is connected to an intermediate zone of a fourth rigid arm 22, the outer end of which is hinged in known manner to an arm 40 of a known assembly 41 of levers for operating an excavating shovel or bucket 24. Said arm 40 is operated by virtue of the fact that it has connected to it the end of a rod of an actuator 25, the body of which is fixed to an inner end 42 of the arm 22. This latter is able to rotate, by way of the pin 36, in a plane perpendicular to the floor 1 and parallel to that in which the first arm 7 can move, and is controlled by a rod actuator 23 fixed between the end 42 of the arm 22 and the inner end 44 of the arm 19. The arm 19 is also provided with a vertical fixing pin 27 which can engage in bores 28 provided in the end 16 of the arm 10.

Figure 3:
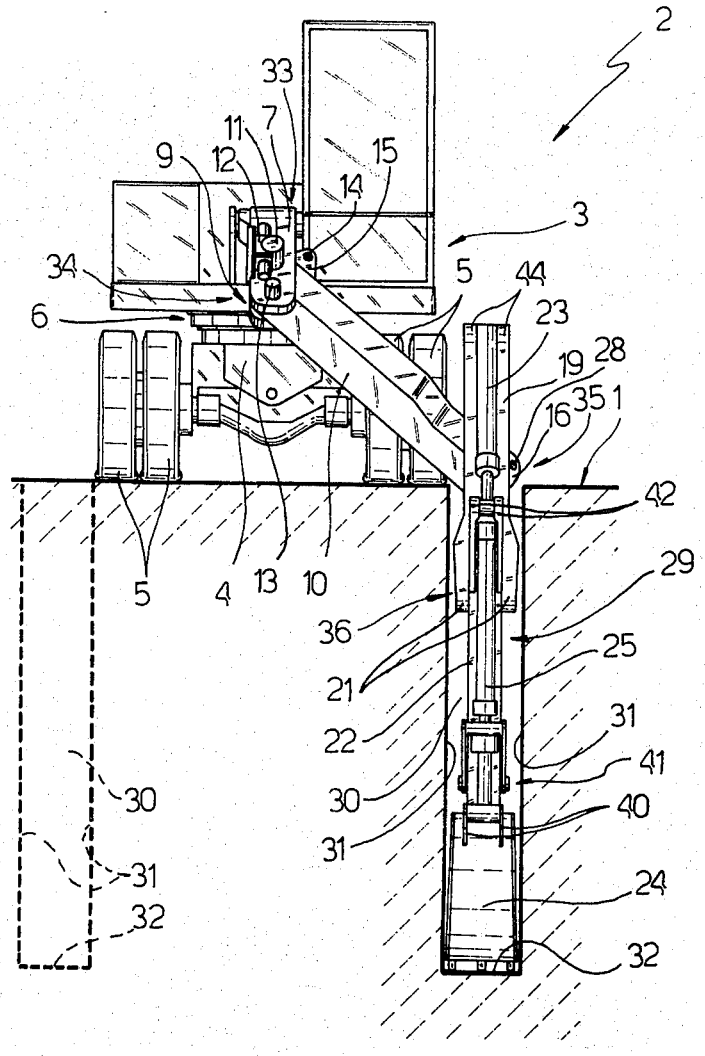
FIG. 3 is a front view of the excavator of FIG. 1, shown in its working position while excavating a deep trench.

In FIG. 3, the excavator 2 is shown excavating a trench 30 lateral to the excavator, its walls 31 being perfectly parallel nd perpendicular to the working floor 1 and to a base 32.

Thus, if the excavator 2 is able to straddle the excavation, the arm 10 will not be rotated, and thus the plane of its axis will coincide with that of the arm 7 and arm 19, and with the turret 3 in a non-rotated position the entire articulated arm 29 will operate in the vertical plane of symmetry of the excavator. The bucket 24 is then made able to excavate by moving the arms 7 and 22 in this plane by means of the articulated joints 33 and 36.

However, in order to make a lateral excavation, the pins 13 and 27 are removed from the bores 14 and 28 in which they are located, and the arms 10 and 19, thus released, are rotated by means of the hydraulic actuators 12 and 20 so that the arm 19 becomes disposed in a plane parallel to the vertical plane of symmetry of the excavator and thus perpendicular to the working floor but passing to the side of the excavator.

Further bores 14 and 28 serving as reference bores are provided to correspond with the new position assumed by the arm 10, and enable the pins 13 and 27 to be reinserted in order to lock the arms 10 and 19 so as not to overload the hydraulic actuators 12 and 20 during the excavation.

By means of this operation, the excavating shovel 24 and the corresponding arm 22, which are rigid with the arm 19, assume a position in the excavation plane to the side of the excavator, while at the same time remaining parallel to the arm 7 which on being lowered enables the excavation to be made in depth. As the arms 22 and 19 carrying the bucket 24 are parallel to the arm 7, the movement of the bucket 24 takes place in a manner rigorously perpendicular to the working floor 1, thus giving walls 31 which are perfectly flat, parallel, and perpendicular to the floor 1.

The advantages of the present invention are apparent from the aforegoing description. In a simple manner, it enables a result to be obtained which cannot be obtained by any of the known devices, in that it enables a lateral excavation to be made which is perfectly perpendicular to the working floor and at the same time of considerable depth, while maintaining a limited overall machine width. When moving the vehicle on the road, this width can be made equal to the machine gauge by rotating the arm 19 backwards into a suitable position defined by reference and fixing bores, thus also reducing its overall length.

Furthermore, all the excavation operations are carried out without rotating the turret 3, which is moved only for unloading the removed material, for example into the back of a suitable truck. This characteristic enables the operator to always operate under the best possible conditions, with excellent visibility of the excavation, and thus overall enables more accurate work to be carried out, and dispenses with the need for any costly manual finishing operations on the excavation.

From the description it is apparent that modifications can be made to the structure according to the present invention without leaving the scope of the inventive idea. In particular, the arms 10 and 19 can be moved in the plane parallel to the working floor by hydraulic rod actuators mounted to the side of the arms and of the same type as those (23,25) used for the other movements of the articulated arm 29, or by hydraulic motors, or again manually without any actuator, or further by placing the bucket 24 on the working floor and rotating the turret 3. The position assumed by the arms 10 and 19 is then fixed by the pins 13 and 27. In addition, the number of component arms and articulated joints of the articulated arm 29 can be varied, provided this number allows the shovel 24 to be moved in a plane parallel to the plane containing the first arm 7 and perpendicular to the working floor 1.

Finally, the articulated arm 29 according to the present invention can be fitted to excavator machines of a type other than that illustrated. In particular, it can be fitted to the rear region of tractors of the rough terrain vehicle type, for example comprising a slide slidable along guides perpendicular to the longitudinal axis of the vehicle. By sliding this slide, the distance of the excavation line from the side of the vehicle can be further increased.

What we claim is:

1. An articulated arm mounted on an excavator vehicle to permit the excavator which is movable along a working floor to make an excavation lateral thereto and parallel to the vehicle line of travel, comprising:

(a) a rigid arm hingedly connected at one end to the excavator vehicle to permit the arm to move in a vertical plane perpendicular to the working floor, (b) a second horizontally movable arm hingedly connected through a pin assembly to the other end of the first arm to permit the second arm to swing in a substantially horizontal direction to either side of the vehicle, (c) the other end of the second arm hingedly supporting a third arm at one end thereof through a pin assembly for rotational movement in the same plane as the second arm, such that it can also move in a substantially horizontal direction, (d) a fourth and shovel supporting arm hingedly connected to the other end of the third arm to permit it to move in a plane perpendicular to the plane containing the line of movement of the third arm, (e) the hinged connections at each end of the second arm including an upright hinge pin, (f) a motor directly mounted on each of the second and third arms in substantial alignment with and directly connected to the hinge connections for permitting movement of the interconnected arms in a large arc, (g) locking-pin means associated with each of the hinge connections for permitting an arcuate locking arrangement of the second arm with respect to the first arm and the third arms, (h) the locking means including a plurality of arcuately spaced fixing bores on one of the arms of each hinged connection at each end of the second arm, and a fixing pin integral with the other arm of each hinged connection which can be moved to engage any of the fixing bores.

2. An articulated arm for an excavator vehicle as set forth in claim 1, wherein:

(a) the motors mounted at the hinge connections are hydraulic motors.

3. An articulated arm for an excavator vehicle as set forth in claim 1 or 2, wherein:

(a) the motor and fastening pins at the end of the second arm permit the third arm to be moved to a rearward stored position.

4. An articulated arm for an excavator vehicle as set forth in claim 1 or 2, wherein:

(a) a toothed wheel is connected to an end of each hinge pin and is engaged by a worm gear of the motor.

* * * * *